US005975169A

United States Patent [19]

Jonkka et al.

[11] Patent Number: 5,975,169

[45] Date of Patent: Nov. 2, 1999

[54] FEEDING METHOD AND FEEDING CHUTE OF DISC CHIPPER

[75] Inventors: Arvo Jonkka; Antti Tohkala, both of Pori; Hannu Tähkänen, Rauma, all of Finland

[73] Assignee: Sunds Defibrator Woodhanding Oy, Pori, Finland

[21] Appl. No.: 09/119,229

[22] Filed: Jul. 21, 1998

[30] Foreign Application Priority Data

Jul. 22, 1997 [FI] Finland ..... 973078

[51] Int. Cl.[6] ..... B27L 11/00; B27C 7/00

[52] U.S. Cl. ..... 144/373; 144/162.1; 144/176; 144/180; 241/92

[58] Field of Search ..... 144/162.1, 176, 144/180, 329, 363, 373; 241/92, 30, 34, 278.1, 296

[56] References Cited

U.S. PATENT DOCUMENTS

| | | | |
|---|---|---|---|
| 3,392,763 | 7/1968 | Ledergerber | 241/92 |
| 5,139,063 | 8/1992 | Nettles et al. | 241/92 |
| 5,261,469 | 11/1993 | Severson | 144/176 |
| 5,293,917 | 3/1994 | Kalliokoski | 144/176 |
| 5,417,263 | 5/1995 | Jorgensen | 241/92 |
| 5,660,218 | 8/1997 | Jonkka | 241/92 |

*Primary Examiner*—W. Donald Bray
*Attorney, Agent, or Firm*—Burns, Doane, Swecker & Mathis, L.L.P.

[57] ABSTRACT

A method and a feeding chute for feeding logs (10) into a disc chipper by means of the gravity. The logs (10) are supported laterally by means of adjacent bottom portions (31, 32) of the chute (3) and shoulders between those. The logs are turned parallel with the longitudinal direction of the chute by means of a moment (M) which occurs when the direction of the main axis (27) of the ellipse forming the shearing surface of the log deviates from the direction (27') perpendicular to a the direct line (30) drawn via the rotating center (28) of the blade disc and the center (29) of the ellipse. The bottom portions (31, 32) of the chute are inclined around a longitudinal axis in such a way that from two adjacent bottom portions of the chute, the one (31) further away from the rotating axis of the disc forms a bigger angle (β') with respect to the horizontal plane than the angle (β") formed by the portion (32) closer to the rotating axis.

10 Claims, 9 Drawing Sheets

FEEDING METHOD AND FEEDING CHUTE OF DISC CHIPPER

BACKGROUND AND SUMMARY

The present invention concerns a feeding method and a feeding chute of a disc chipper fed by means of the gravity. In the pulp and paper industry, a disc chipper is generally used for chipping wood prior to further processing. In a chute fed chipper, the logs are fed along an inclined chute against the blade disc of the chipper. The blade disc rotates around a horizontal or less than 20° inclined axle. The logs slide against the blade disc due to the gravity. Knives are attached to the blade disc in about the direction of the radius, chipping the wood against a stationary counter blade.

The logs encounter the blade disc at a feeding angle which in a chute fed chipper is the angle between the plane of the disc and the plane including the log and perpendicular to the plane of the disc. Test have shown that the quality of chips improves when the feeding angle between the log and the blade disc is decreased. The decreasing of the feeding angle is, however, restricted by the increase of the size of the shearing ellipse of the head of the log, which results in the decrease of the cross section the feeding funnel, if the feeding opening cannot be enlarged at the same time. In addition, practice has proven that smaller feeding angles increase feeding problems of the chipper, as the shearing surface of the log increases and the balancing effect of the gravity on the feed decreases.

The need of enlarging the feeding chute has become the primary problem, which has the effect that the feeding of wood is uncontrollable with the methods of prior art. When small test plants give a good chipping result with the new chipping angles, the quality of the chips with mass production chippers remains significantly lower.

Manufacturers of chippers have developed different feeding methods, which differ from the traditional structure, but these feeding methods, however, have the problem of the restless moving of the logs, especially laterally. The smaller the diameter and the length of the log is, the more lateral movement there is. Slim logs have more space laterally. The length of the logs gets shorter in chipping, so that at the end of chipping the short logs can easily change their direction and turn as much as 90°, so that no chips are produced any more.

According to the invention the feeding of the logs into the chipper is provided so that they maintain their feeding direction better. Thus, the problem can be avoided that the chipper would be blocked by transversal logs which have changed their direction, or that when the feeding direction is changed, the size of the chips would be changed and oversized chips would be produced.

BRIEF DESCRIPTION OF THE DRAWINGS

The invention and its details will be described in more detail in the following, with reference to the enclosed drawings, wherein.

DETAILED DESCRIPTION

Figure 1:
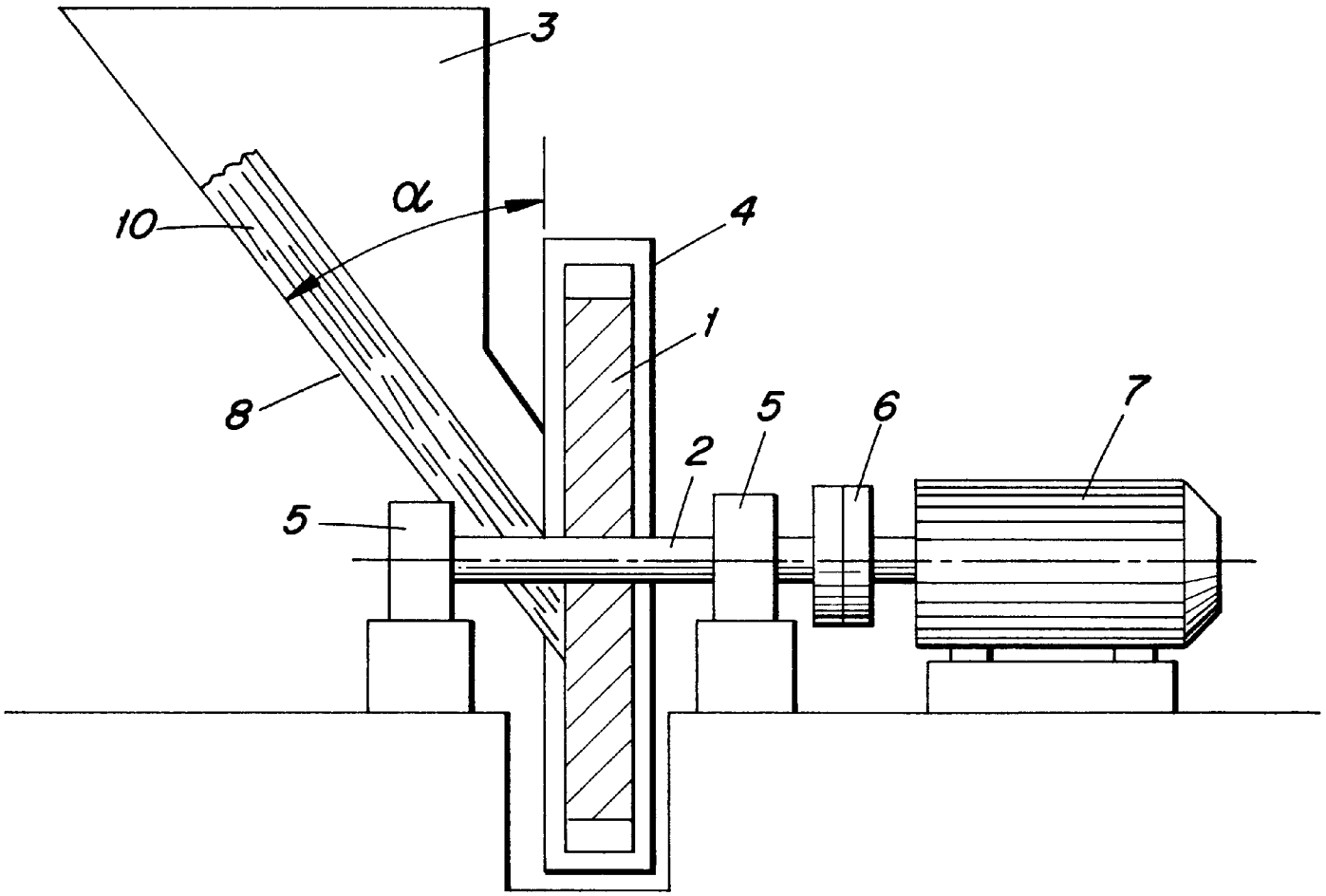
FIG. 1 shows the feeding of logs into a chipper, viewed from one side, in a known feeding construction.

FIG. 1 shows a disc chipper presently used for the chipping of wood. The chipper comprises a blade disc 1, a shaft 2, a feeding chute 3, a housing 4 and bearings 5. The drive of the chipper consists of a coupling 6 and a motor 7. The logs 10 to be chipped are fed into the chipper so that the angle between the fed log 10 and the blade disc is $\alpha$. The angle in question is traditionally 38°, and the logs rest relatively stable against the bottom 8 of the feeding funnel. In new chippers the angle a is only 32°, and thus, the surface pressure of the logs against the bottom of the feeding chute is significantly smaller, while the shearing area of the head of the log is significantly larger. This results in that the logs easily turn during the chipping, so that the quality advantage achieved by the change of the feeding angle is reduced.

Figure 2:
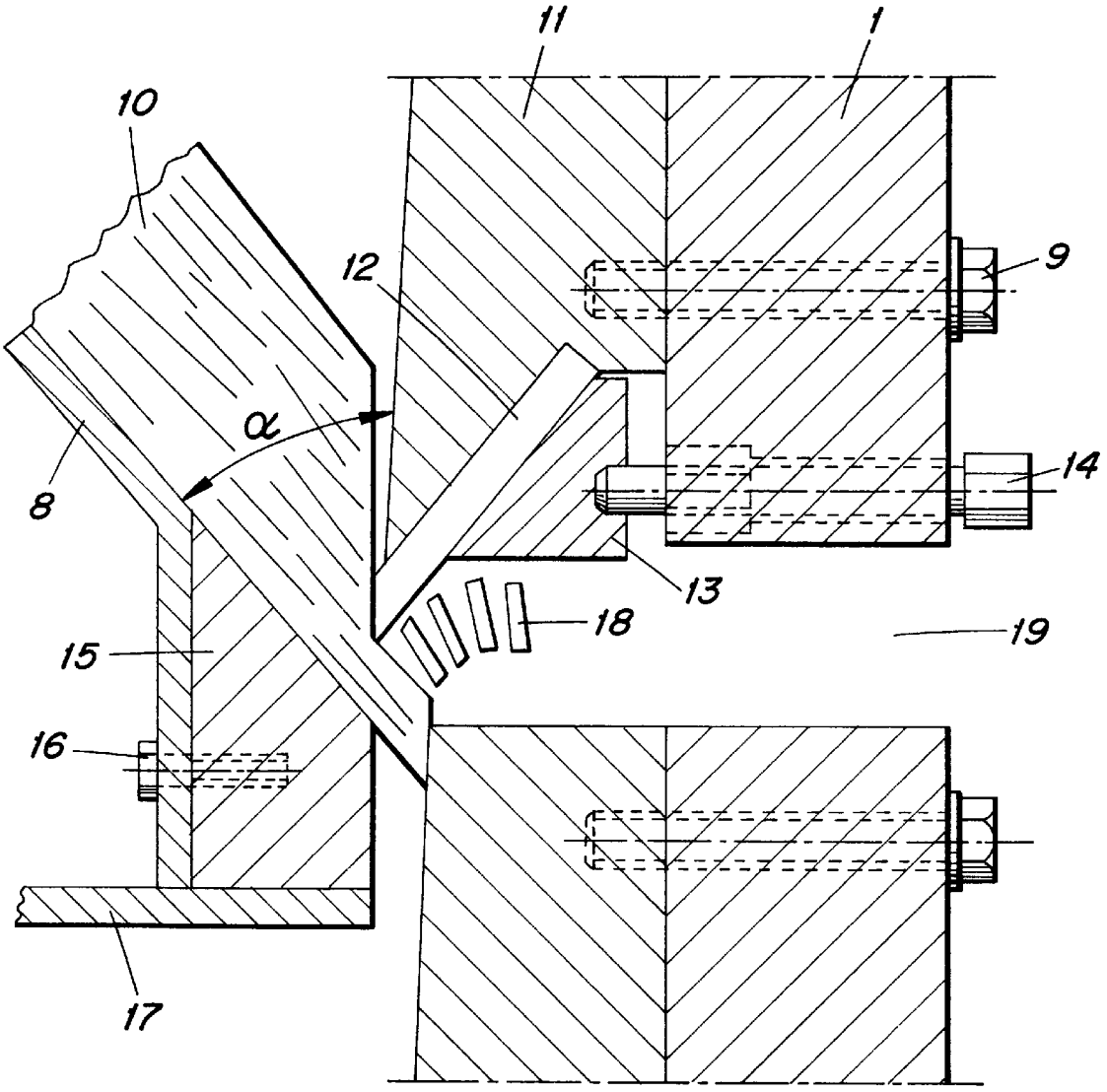
FIG. 2 shows a general knife arrangement of a disc chipper.

FIG. 2 shows a conventional blade arrangement of a chipper. Wear plates 11 are attached by means of bolts 9 to the blade disc 1. The knives 12 of the chipper are kept in their position by means of a knife base 13 and knife bolts 14. The support construction 17 of the bottom 8 of the feeding chute forms a support base for a counter blade 15, the upper surface thereof having the shape of the bottom of the chute 8 and forming an extension to the chute, receiving the chipping forces and, being subject to strong wearing, easily changeable because it is fixed by bolts 16 to the base 17. The logs 10 are fed against the wear plate 11, and the knives 12 cut off chips 18 which are discharged along an opening 19 in the blade disc 1. Good quality of chips requires that the logs 10 encounter the blade disc in a correct position so that the angle a remains stable and no lateral angles occur.

Figure 3:
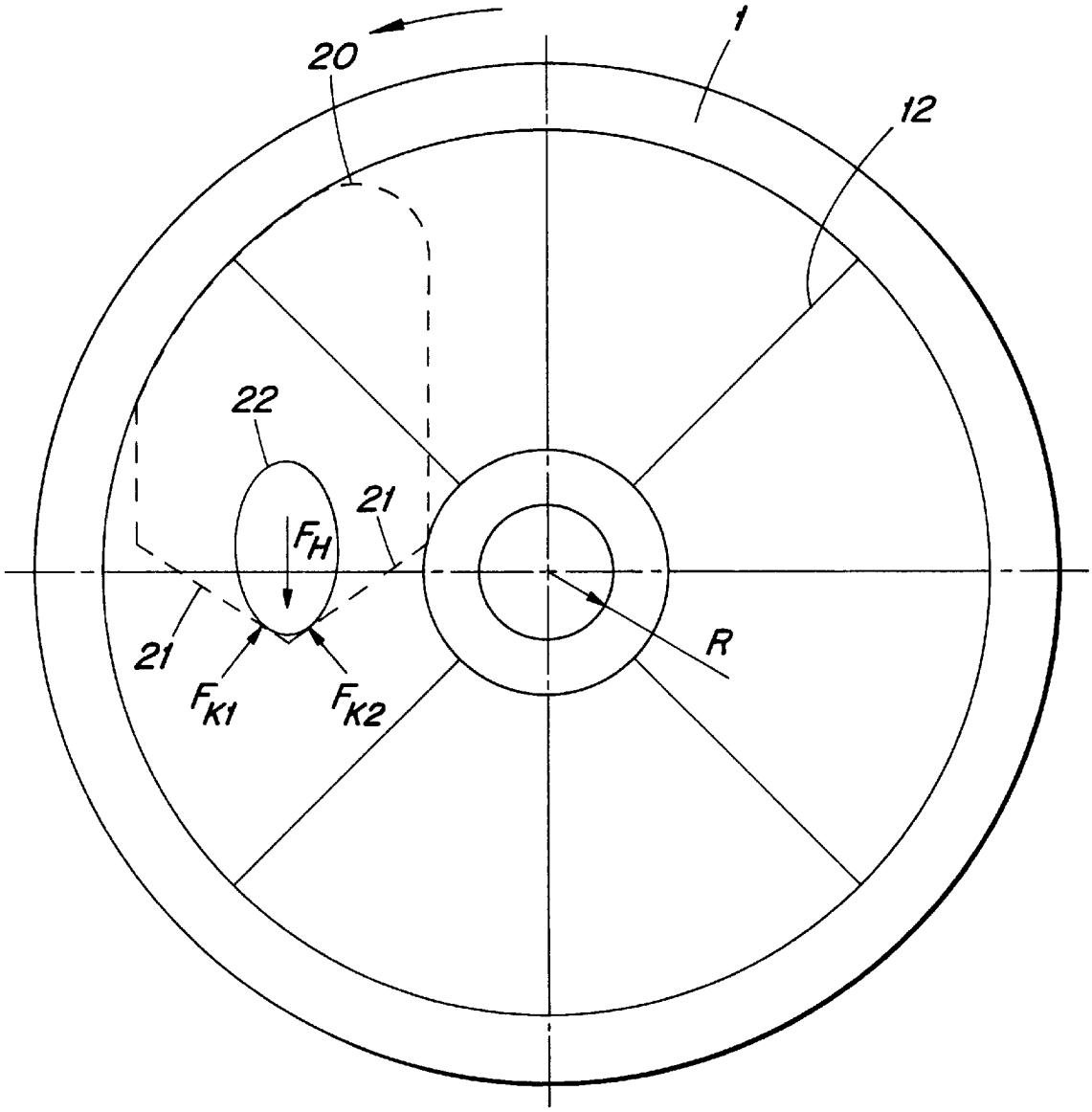
FIGS. 3 and 4 show the plane of the disc of two traditional chippers, viewed from the feeding direction of the wood.

FIG. 3 shows a plane of the blade disc 1 with knives 12. The housing of the feeding chute 3 is shown with a dashed line 20, and the surface plane of the counter blade forming the lower end of the chute is shown with a line 21. The shearing area of the log is shown by an ellipse 22. The chipping force $F_H$ forms supporting forces $F_{K1}$ and $F_{K2}$ on the surface of the counter blade. The surface shape of the counter blade in accordance with FIG. 3 provides a stable feeding to the log 10 by means the two supporting forces $F_K$, but a disadvantage is the fact that $F_{K1}+F_{K2}>F_H$. The result therefrom is that the sliding of the log becomes more difficult, due to the friction force caused by the forces $F_{K1}+F_{K2}$ and acting on the lower surface of the log, so that the contact pressure of the tail of a short log decreases or totally disappears, so that the log in question stands up and the feeding angle a changes.

Figure 4:
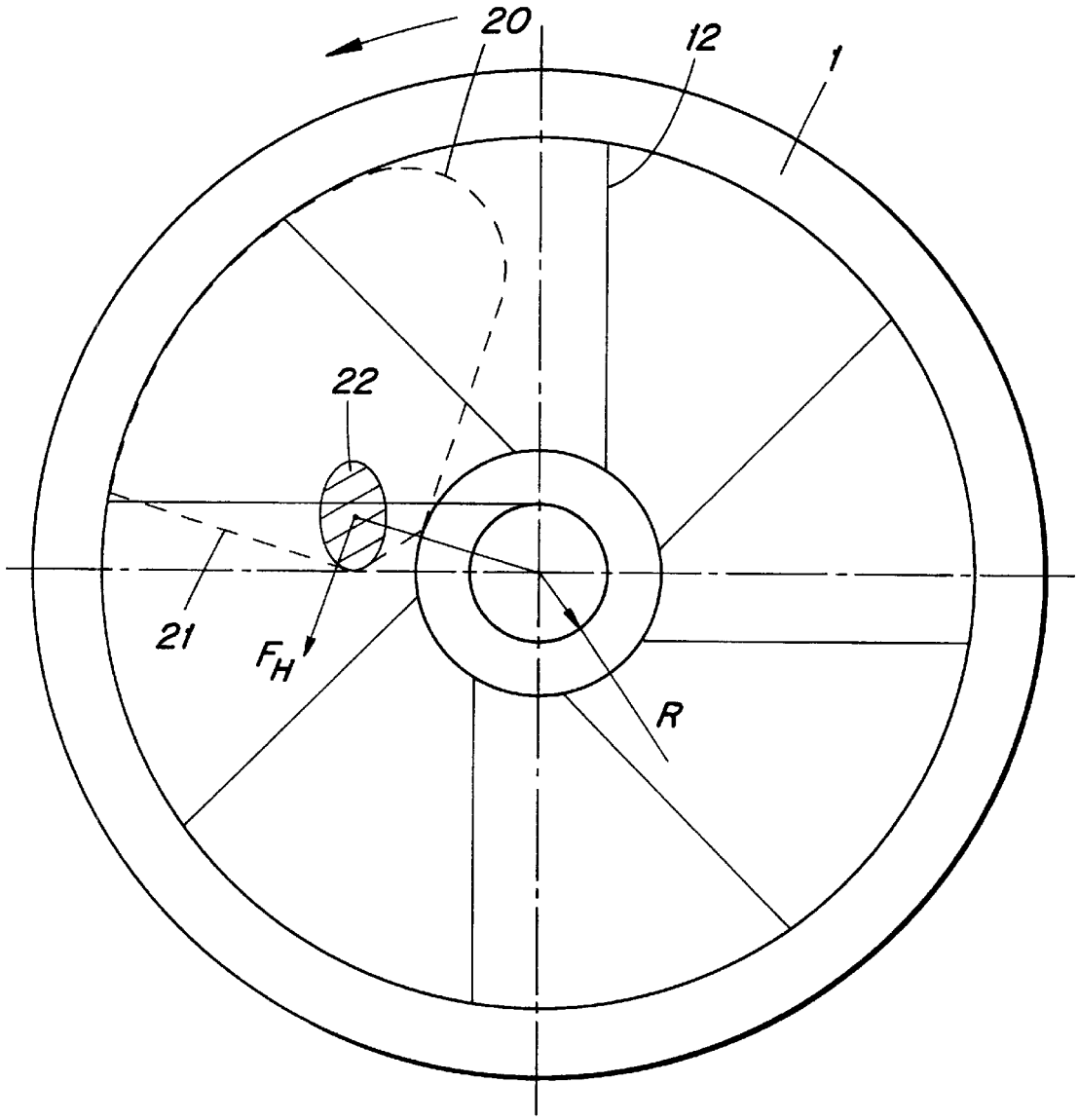

The chipper of FIG. 3 has a "radial knife" which "chops" off the chips and there is no cutting movement in the direction of the cutting edge of the knife. Generally, chippers are provided with knives 12 that are placed ahead of or after the radius. One chipper of this kind is e.g. the traditional Carthage chipper of the 50's, constructed in accordance with FIG. 4, with a knife 12 arranged after the radius. In the chipper of FIG. 4, the knives are placed behind to the extent of an auxiliary circle R. The radius R forms a circle, on the tangent of which the points of the knives are arranged. The radius R defines the cutting speed in the direction of the cutting edge of the knife. When the knife is arranged after the radius, this cutting force pushes the log outwards from the shaft, thus compensating the "scissors force" acting towards the shaft. Thus the feeding of the logs to the chipper is improved, because $F_H$ acts almost perpendicularly with respect to the surface 21 of the counter blade, and no additional drag forces occur. By the term "scissors force" the chipper manufacturers understand a force that results from the angle between the knife and the counter blade and acts in the direction of the opening of the angle in question.

Figure 8:
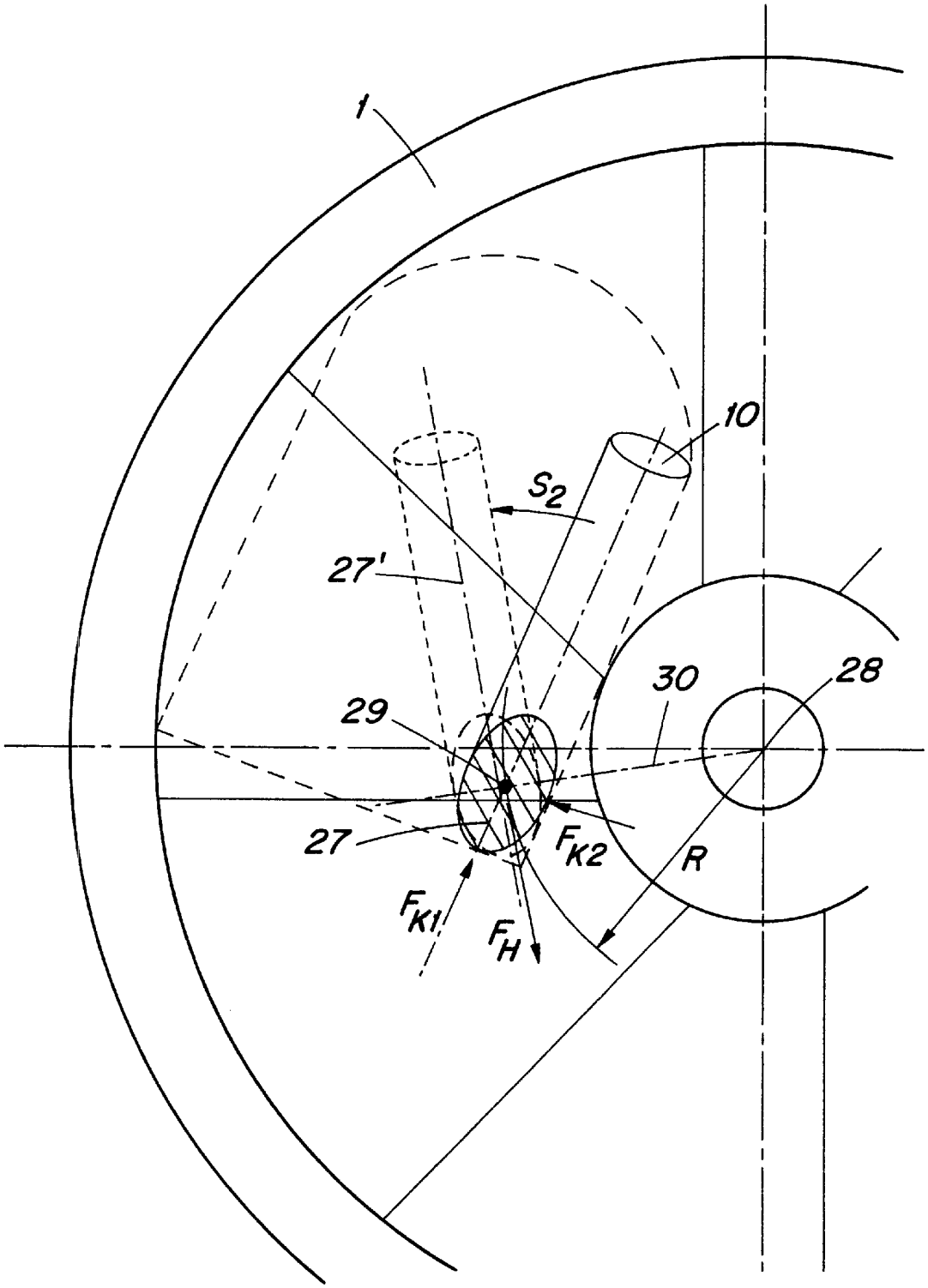
FIGS. 8 and 9 show the functions of the feeding method in accordance with the invention.

The feeding chute of FIG. 8 is provided with knives arranged ahead of the radius, and the cutting force acting on the direction of the cutting edge of the knife pulls the logs towards the shaft so that $F_H$ acts on the corner between the counter blade and the inner side of the feeding chute, so that $F_{K1}$ and $F_{K2}$ form a strong friction force creating problems to the feeding of the wood. The chute of FIG. 8, however, operates well with big logs and with a relatively small production.

Figure 5:
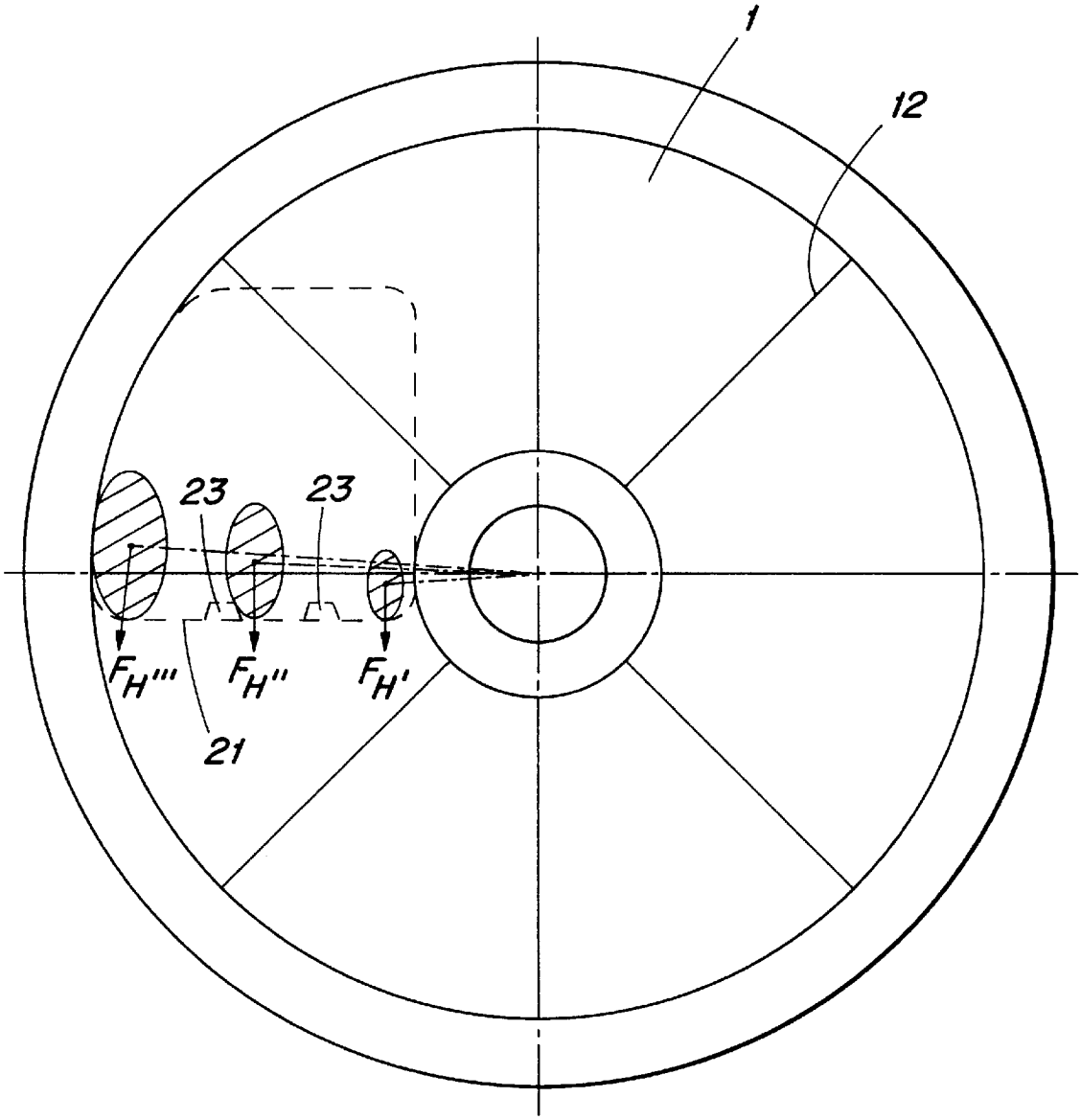
FIG. 5 shows the plane of the disc and the feeding chute of a newer chipper, whereby it has been tried to improve the control of logs by means of guiding battens.

Today, however, the mass production requires chippers that can chip a great number of logs at the same time. Therefore chippers e.g. shown in FIG. 5 have been constructed, having a large feeding opening and almost a horizontal chipping surface 21 of the counter blade. This levelled bottom construction does not provide guiding of the logs by the gravity, and the radial knives do not give cutting forces in the direction of the cutting edge of the knife. The logs are only guided by the "scissors forces" which are dependent on the diameter of the log. This has the result that the "scissors force" tends to move big logs from the inner circle to the outer periphery and vice versa. An even surface of the counter blade gives only one supporting force $F_K=F_H$ and therefore the logs turn away from the chipping position, which results in poor chipping production. As a corrective measure, it has been tried to prevent the movement of logs by battens 23 parallel with the logs, preventing the logs from moving in both lateral directions.

So, among the feeding methods of FIGS. 3, 4, 5 and 8, the one of FIG. 4 is the best, because every log is supported against the surface 21 of the counter blade, so that $F_H$ is only slightly bigger than the components $F_{K1}+F_{K2}$. Thus, the feeding of the chipper in accordance with FIG. 4 operates well also when more logs than one are fed, as the chipping force $F_H$ mainly acts on the surface 21 of the counter blade, and a minor side force to the next log does not disturb the feeding.

Figure 6:
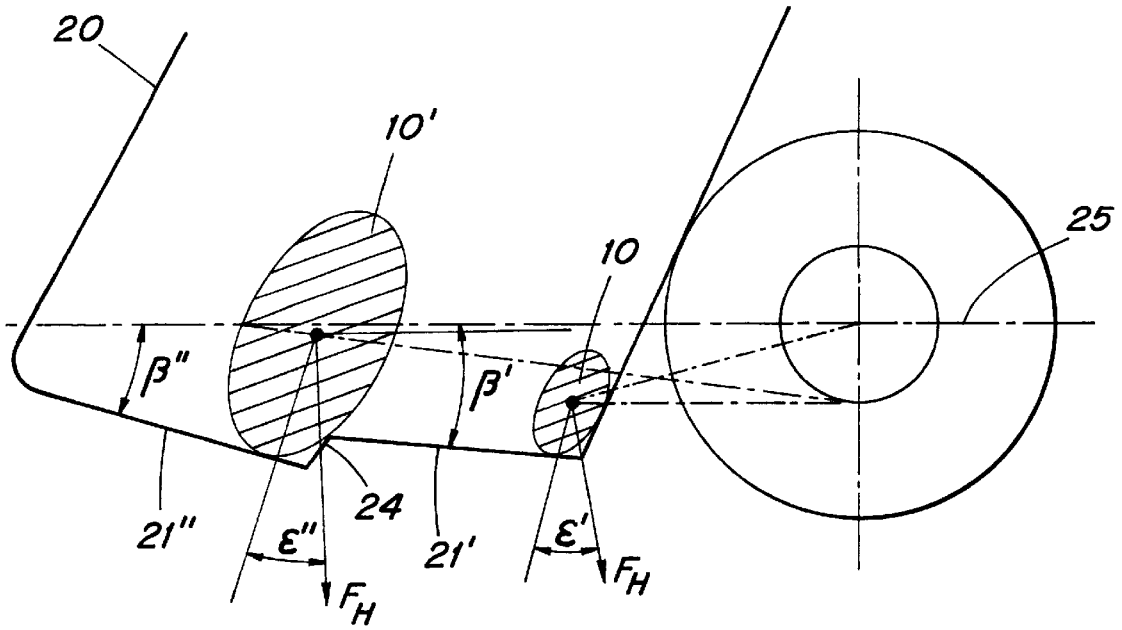
FIGS. 6 and 6*a* show a feeding chute in accordance with the invention.

The feeding method and the construction of the feeding chute in accordance with the invention is based on the analyzing of the operation problems of the mass production chippers and on the utilization of the phenomena disturbing the chipping. A significant feature of the invention is the fact that the feeding of the wood in a traditional well functioning chipper is implemented in a plurality of chipping positions so that a good and stable guiding of the log is achieved also with a large feeding chute. This is achieved by shaping the bottom of the feeding chute and the counter blade in such a way that the chipping force is directed so that the friction force against the bottom of the feeding chute and the counter blade of the lower part thereof is increased only a little by dividing the chipping force into a great main supporting force and a considerably smaller guiding side support force. A feeding chute in accordance with the invention, provided with two chipping positions, is shown in FIG. 6, where logs 10 and 10' are guided into the right chipping direction in different chipping positions which are arranged side by side on the upper surface of the counter blade. The surface 21' of the counter blade facing next to the shaft forms an angle β' with the horizontal centre line 25 of the surface of the blade disc of the chipper. The outer surface 21" of the counter blade forms a bigger angle β" with respect to the centre line 25 of the blade disc of the chipper. per. The deviation angle ε' and ε" of the chipping force $F_H$ from perpendicular to the counter blade defines the magnitude of the laterally guiding support force.

Figure 6A:
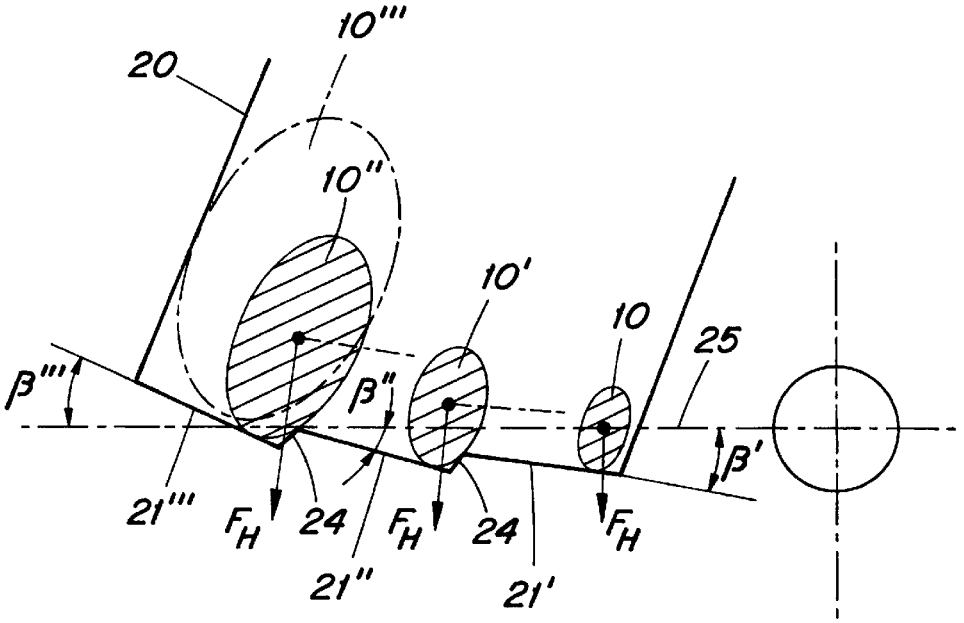

FIG. 6*a* shows a counter blade of the chipper with three adjacent chipping positions or logs 10, 10' and 10". The support surface of the counter blade is formed by three successive portions 21', 21" and 21'", which have the angles β', β" and β'" with respect to the horizontal centre line 25 of the blade disc. The size order of said angles is such that β'<β"<β'", and they are chosen according to the diameter distribution of the logs and the desired "scissors force" effect. Between the successive counter blade portions of FIGS. 6 and 6*a*, there is a step, in other words a short side wall portion 24 or 24', the height thereof being chosen in accordance with the diameter of the log. A suitable height for example for the log 10' of Ø 200 mm is 25 mm. A suitable angle e.g. between the surface of the step 24 and the surface of the counter blade 21" is about 120–160°, so that the surface 24 forms a firm shoulder.

Figure 9:
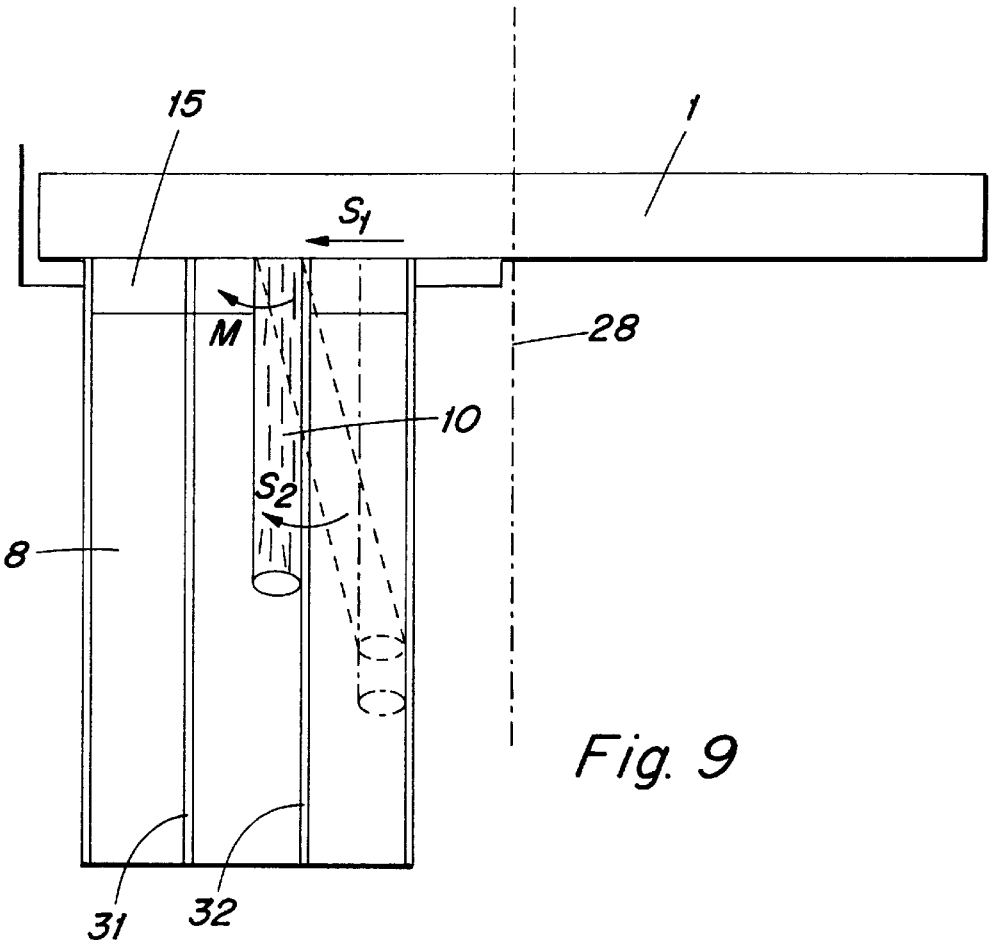
Figure 9A:
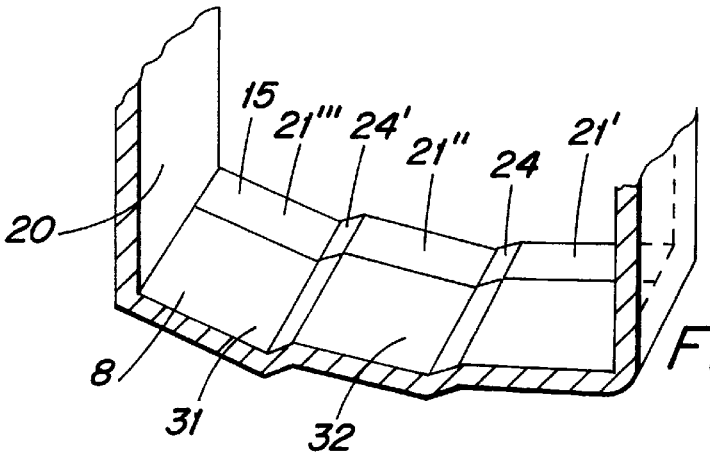
FIG. 9*a* shows the bottom and the counter blade of a feeding chute in accordance with the invention.

The bottom 8 of the feeding chute has the shapes corresponding to the counter blade 15, and two feeding grooves 31, 32 are formed therein, as shown in FIG. 9*a*.

Figure 7:
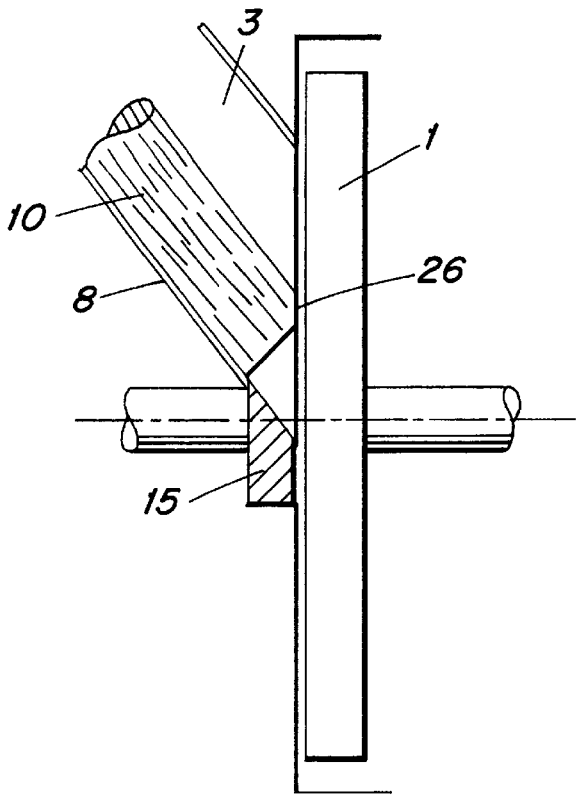
FIGS. 7 and 7*a* show a part of the feeding method in accordance with the invention.
Figure 7A:
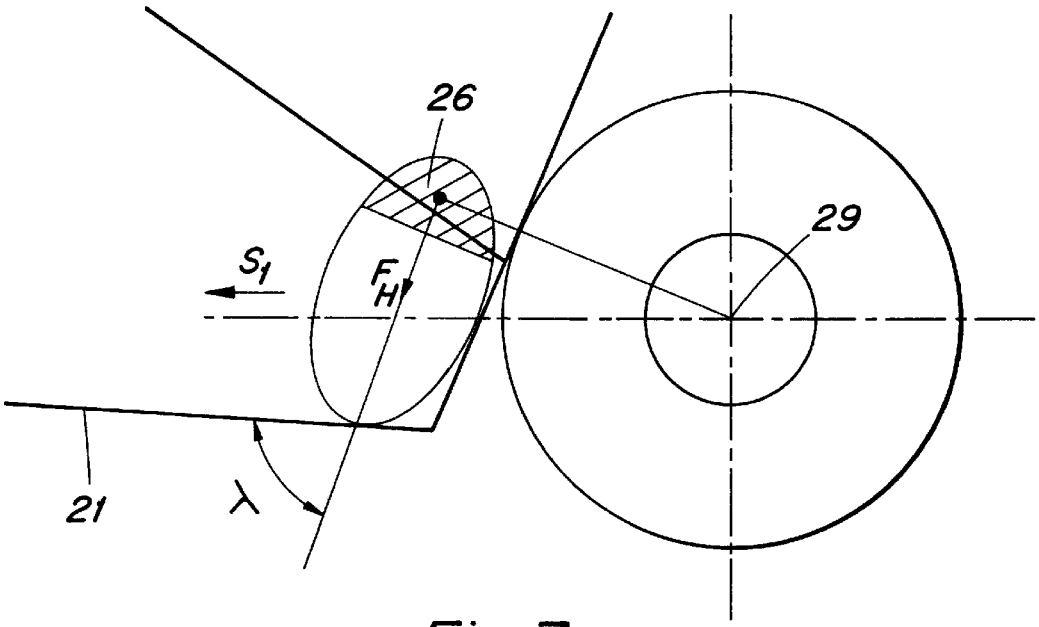

The feeding of the logs fed into the chipper takes place so that the most of the logs slide by the effect of the gravity towards the blade disc at the position shown by the log 10. The head of the log 10 encounters the blade disc 1 as shown in FIG. 7, and when the chipping begins, a small shearing surface 26 is formed, and the shearing force $F_H$ in accordance dance with FIG. 7*a* acts towards the counter blade 21 so that the angle λ between the force $F_H$ and the counter blade 21 is significantly less than 90°, and the log 10 slides outwards from the centre 29 of the blade disc in the direction of an arrow $S_1$, due to the "scissors force".

With a bigger log, the effect of said force is very strong, and the log takes the chipping position of the log 10" shown in FIG. 6*a* against the outermost counter blade portion 21'" or the position 10'" against the outer side wall 20 of the chute 3. Middle sized logs 10' take the chipping position against the blade portion 21", and small logs stay in the chipping position close to the shaft of the chipper, because the knives encounter the small logs so late that no forces pushing the logs outwards are created. The moving of the logs outwards from the centre of the blade disc must be free, as is the situation with a construction in accordance of FIGS. 6 and 6*a*. A feeding chute of FIG. 5 operates poorly in this respect, and the guiding battens only cause disturbances.

In chippers with a large feeding opening it has also been discovered a strong tendency of the logs 10 to turn, as shown in FIG. 8. The turning of the logs in accordance with FIG. 8 results in that the chip quality is lowered, because the logs 10 do not stay in the chipping position.

Test have shown that in case the direction of the main axis 27 of the ellipse forming the shearing surface of the log deviates from the perpendicular with respect to the direct line 30 that goes through the rotating centre 28 of the blade disc and the centre 29 of the ellipse during the chipping, a moment force acts on the log, said moment force turning the log into the direction of an arrow $S_2$ so that the log would take a more advantageous shearing angle, in other words, the main axis of the shearing ellipse would take a position perpendicular to the straight line 30 drawn via the rotating centre 28 of the blade disc and the centre 29 of the ellipse, that is in the direction of the centre line 27' of the ellipse of the turned log as shown in FIG. 8.

The above described force turning the log can be utilized in the operation of the feeding chute in accordance with the invention. When the lower end of the log 10, due to the forces in accordance with FIGS. 6 and 6*a*, takes the chipping position 10' or 10", the moment turning the log 10 increases so that it turns the tail of especially a short log into the groove 31 or 32 in the feeding gap leading to the chipping position, and the feeding direction of the log is right. FIG. 9 shows how the log moves into the guiding groove 31 or 32 of the bottom 8 in the chute 3, and to the chipping position of the counter blade 15. The logs are fed to the position shown by the dotted dash line, and the head, having encountered the blade disc, moves in accordance with the arrow $S_1$, after which there occurs a moment M on the shearing surface of the log, in the position shown by the dashed line, said moment turning the log in accordance with the arrow $S_2$ to the position shown by the unbroken line.

FIG. 9*a* shows the bottom 8 of the feeding chute and the connection thereof to the surfaces of the counter blade.

By means of the above described feeding method, the guiding function of the feeding chute and the counter blade is significantly improved, especially with short logs and with the tails of long logs. The method in accordance with the invention is of significant advantage when the production capacity of the chipper is more than 100 $m^3$/hour with small logs and more than 200 $m^3$/hour with big logs.

What is claimed is:

1. A method for feeding logs into a disc chipper by gravity, comprising the steps of:

loading the logs on a chute, the chute having a bottom that is inclined around a longitudinal axis of a shaft of a chipper blade disc so that gravity directs the logs towards the shaft of the blade disc;

supporting the logs laterally with a housing of the chute;

supporting the logs laterally with adjacent bottom portions of the chute and with one or more shoulders between the adjacent bottom portions so that movement of the logs towards a rotating center of the blade disc is opposed;

turning the logs parallel with a longitudinal direction of the chute by a moment that arises when a direction of a main axis of an ellipse forming a shearing surface of the logs differs from a direction perpendicular to a direct line drawn between the rotating center of the blade disc and the center of the ellipse.

2. A method in accordance with claim 1, comprising the further step of supporting the logs with shoulders an upper surface of a counter blade, the shoulders forming extensions to the one or more shoulders between the bottom portions of the chute.

3. A feeding chute for feeding logs into a disc chipper, the chute comprising:

a bottom;

a counter blade disposed at a lower end of the bottom of the chute;

a housing attached to the bottom of the chute, wherein the bottom of the chute is inclined with respect to a transversal axis in such a way that the bottom of the chute slopes down towards a blade disc of a disc chipper and with respect to a longitudinal axis of a shaft of the blade disc, and wherein the bottom of the chute and the upper surface of the counter blade include adjacent bottom portions between which adjacent bottom portions one or more shoulders form a wall proximate a side of the shaft of the disc.

4. A feeding chute in accordance with claim 3, wherein the bottom portions are inclined around the longitudinal axis such that, for two adjacent bottom portions, a first portion of the two adjacent bottom portions is further away from longitudinal axis and forms a bigger angle with respect to a plane parallel to the longitudinal axis than an angle formed by a second portion closer to the longitudinal axis.

5. A feeding chute in accordance with claim 3, wherein the shoulder forms an angle greater than 90°and opening upwards with at least one of the two adjacent bottom portions.

6. A feeding chute in accordance with claim 5, wherein the angle is between 110–160°.

7. A feeding chute in accordance with claim 4, wherein the shoulder forms an angle greater than 90°and opening upwards with at least one of the two adjacent bottom portions.

8. A feeding chute in accordance with claim 7, wherein the angle is between 110–160°.

9. A feeding chute in accordance with claim 6, wherein the angle is approximately 120°.

10. A feeding chute in accordance with claim 6, wherein the angle is approximately 120°.

* * * * *